US006691933B1

(12) United States Patent
Bosio

(10) Patent No.: US 6,691,933 B1
(45) Date of Patent: Feb. 17, 2004

(54) WATER JET DELIVERY DISK IN KITCHEN SPRAYER

(75) Inventor: Orlando Bosio, Casaloldo (IT)

(73) Assignee: AMFAG S.p.A., Castelgoffredo (IT)

( * ) Notice: Subject to any disclaimer, the term of this patent is extended or adjusted under 35 U.S.C. 154(b) by 0 days.

(21) Appl. No.: 09/526,507

(22) Filed: Mar. 16, 2000

(30) Foreign Application Priority Data

Mar. 22, 1999 (IT) ..... MN990004 U

(51) Int. Cl.[7] ..... A62C 31/00

(52) U.S. Cl. ..... 239/449; 239/106; 239/533.13; 239/546; 239/550; 4/615

(58) Field of Search ..... 239/436, 443, 239/444, 447, 448, 449, 106, 114, 115, 123, 533.13, 546, 548, 550, 562, DIG. 12, 555; 4/615

(56) References Cited

U.S. PATENT DOCUMENTS 5,145,114 A * 9/1992 Monch ..... 239/447
5,699,964 A * 12/1997 Bergmann et al. ..... 239/106
5,707,011 A * 1/1998 Bosio ..... 239/447

FOREIGN PATENT DOCUMENTS

| | | |
|---|---|---|
| EP | 0 885 660 | 12/1998 |
| WO | 95 22407 | 8/1995 |

* cited by examiner

*Primary Examiner*—Lesley D. Morris
*Assistant Examiner*—Christopher S. Kim
(74) *Attorney, Agent, or Firm*—Guido Modiano; Albert Josif; Daniel O'Byrne

(57) ABSTRACT

A water jet deliver disk in kitchen sprayer, comprising a first element, made of a rigid material such as plastic, and constituted by a peripheral body fixable to the sprayer body, by a hub adapted to convey a central jet, and by cross-members connecting the peripheral body and the hub in a monolithic structure and arranged to provide water passage openings, and a second annular element, made of an elastic material and associated with the first element to embed the cross-members in the region between the peripheral body and the hub, and comprising holes for water passage which are arranged at the passage openings formed by the cross-members to provide jet.

8 Claims, 3 Drawing Sheets

WATER JET DELIVERY DISK IN KITCHEN SPRAYER

BACKGROUND OF THE INVENTION

The present invention relates to a water jet delivery disk in a kitchen prayer.

It is known that devices for conveying water to kitchen sinks, known as sprayers, have become widespread; they comprise an elongated body which ends with a head that contains a mechanism which produces, by simple actuation by the user, the delivery of water alternatively from a central opening, usually provided with an aerator, or from holes arranged within a peripheral band all around the central opening within a disk provided with means for fixing to the head: this alternatively provides the so-called center jet and rim jet.

A typical problem suffered with the described sprayers is that the water contained in the holes that provide the rim jet leaves, by evaporating in the end region proximate to the outlet of the holes, scale deposits which tend to gradually clog the holes.

The prior art has therefore proposed a solution to the problem which consists in providing the water passage holes inside small tubes made of elastic material, such as rubber, which protrude by an extent which is proximate to the water delivery section from the rigid disk that contains them. It is thus possible to manually apply an action which elastically deforms the protruding portions of the tubes inside which scale deposits have formed, so as to break up the deposits and make them available for removal by means of a subsequent water stream.

In the prior art devices, the tubes made of elastic material are associated with a rigid disk that contains them in a way which does not provide absolute certainty as regards the stability of the coupling.

SUMMARY OF THE INVENTION

The aim of the present invention is to provide a water jet delivery disk in a kitchen sprayer in which the ducts of elastic material for conveying the water intended to form the rim jet are fixed so as to offer maximum assurance against any possibility of separation.

This aim is achieved by a water jet delivery disk in kitchen sprayer, according to the invention, comprising:

- a first element, made of a rigid material, which comprises a peripheral body, provided with means for fixing to a sprayer body, and a hub which is designed to convey a central jet, said peripheral body and said hub being rigidly coupled to each other by means of cross-members which are spaced so as to allow passage openings to form;
- a second annular element, made of an elastic material, which is associated with the first element at least in a region between the peripheral body and the hub where the cross-members are present, so as to be crossed by said cross-members, and comprises holes for the passage of water at the openings that lie between said cross-members, said holes being suitable to provide a rim jet, a protrusion being provided which protrudes from a surface of said second element that is directed toward the outside of the sprayer at an outlet section of each one of said holes.

BRIEF DESCRIPTION OF THE DRAWINGS

Further characteristics and advantages of the present invention will become apparent from the following detailed description of a water jet delivery disk, illustrated only by way of non-limitative example in the accompanying drawings, wherein.

DESCRIPTION OF THE PREFERRED EMBODIMENTS

Figure 1:
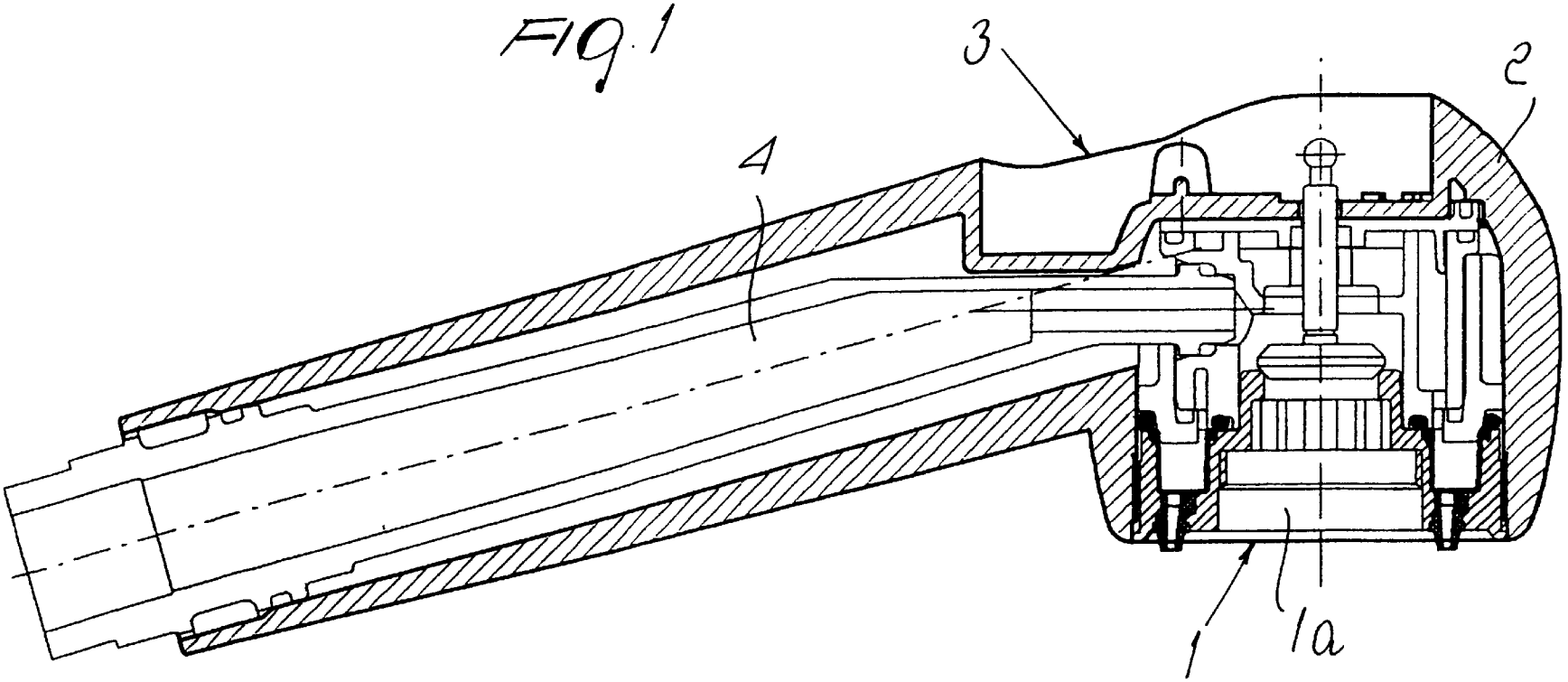
FIG. 1 is a transverse sectional view of a sprayer which comprises the disk according to the invention.
Figure 3:
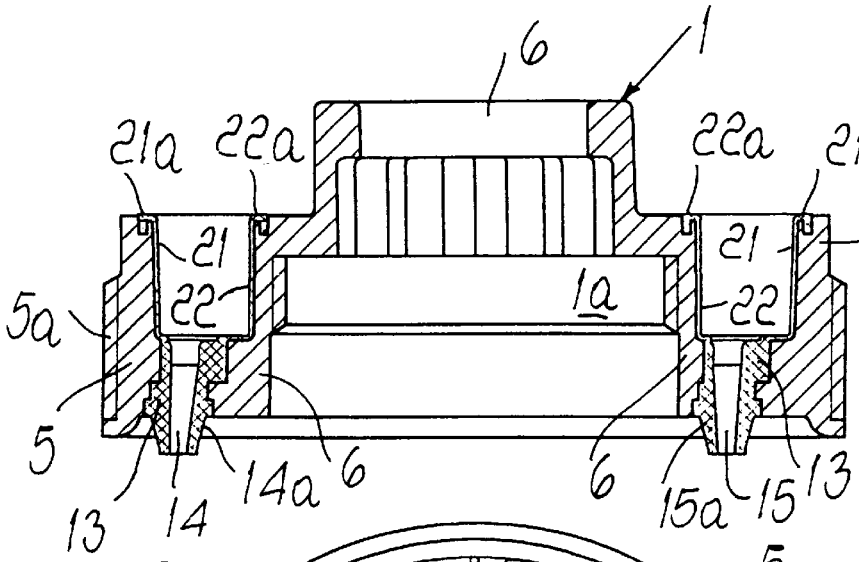
FIG. 3 is a sectional view, taken along the plane III—III of FIG. 2, but with the second element fully present.
Figure 2:
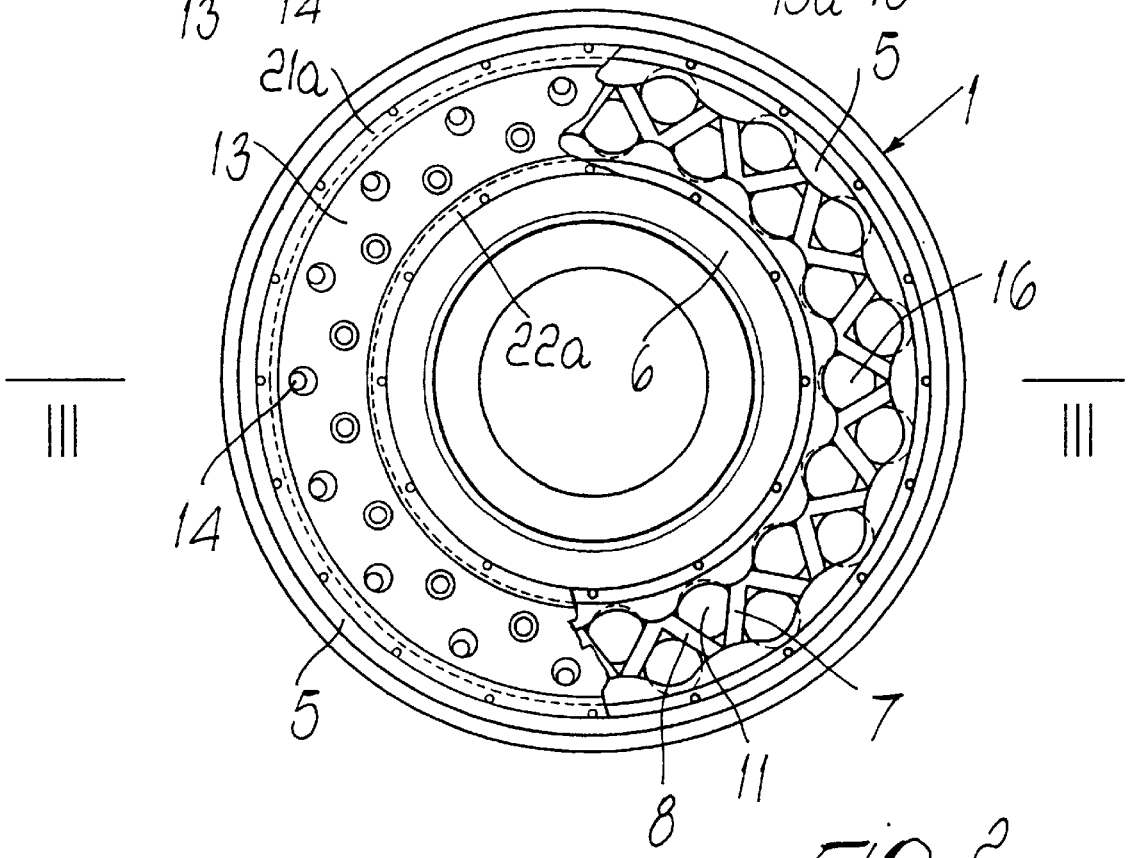
FIG. 2 is a plan view of the disk, taken from inside the sprayer, with the second element made of elastic material shown removed in the right portion of the figure.

With reference to the above figures, 1 generally designates the disk according to the invention, which in FIG. 1 is shown associated with a head 2 of a sprayer 3.

The head receives water through a duct 4, and contains a mechanism, which is per se known and therefore not described in detail, which allows to selectively provide a center jet, in which water flows out of a central region of the disk 1 where, in the portion of space 1*a*, there is usually an aerator, not shown in the figures for the sake of clarity, or the rim jet, in which water flows out of the peripheral region of the disk, as specified hereinafter.

The disk 1 comprises a first element, made of a rigid material such as plastics, which comprises a peripheral body 5, provided with means for fixing to the head 2 of the sprayer which are constituted by a thread 5*a*, and a hub 6, which comprises the portion of space 1*a* and is designed to convey the center jet. The peripheral body 5 and the hub 6 are monolithically rigidly coupled by means of cross-members such as 7, 8, 9 and 10 which are arranged so as to form passage openings 11 between the cross-members 7, 8 and 12 between the cross-members 9 and 10.

Figure 5:
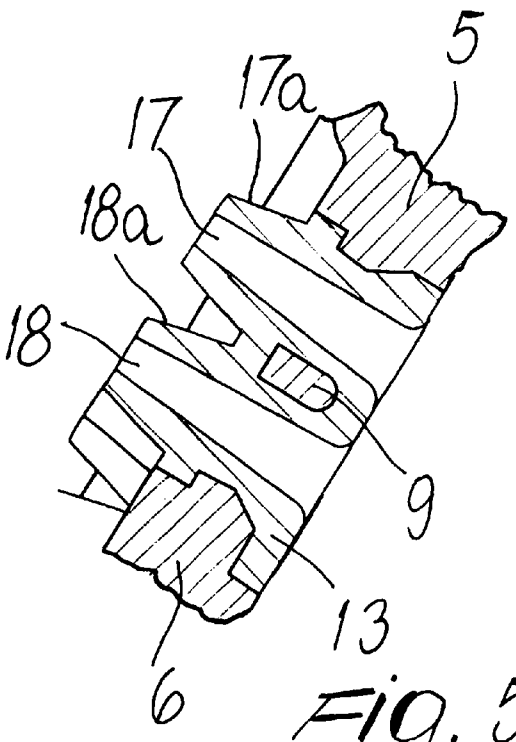
FIG. 5 is a partial sectional view, taken along the plane V—V of FIG. 4, in the presence of the second element.
Figure 4:
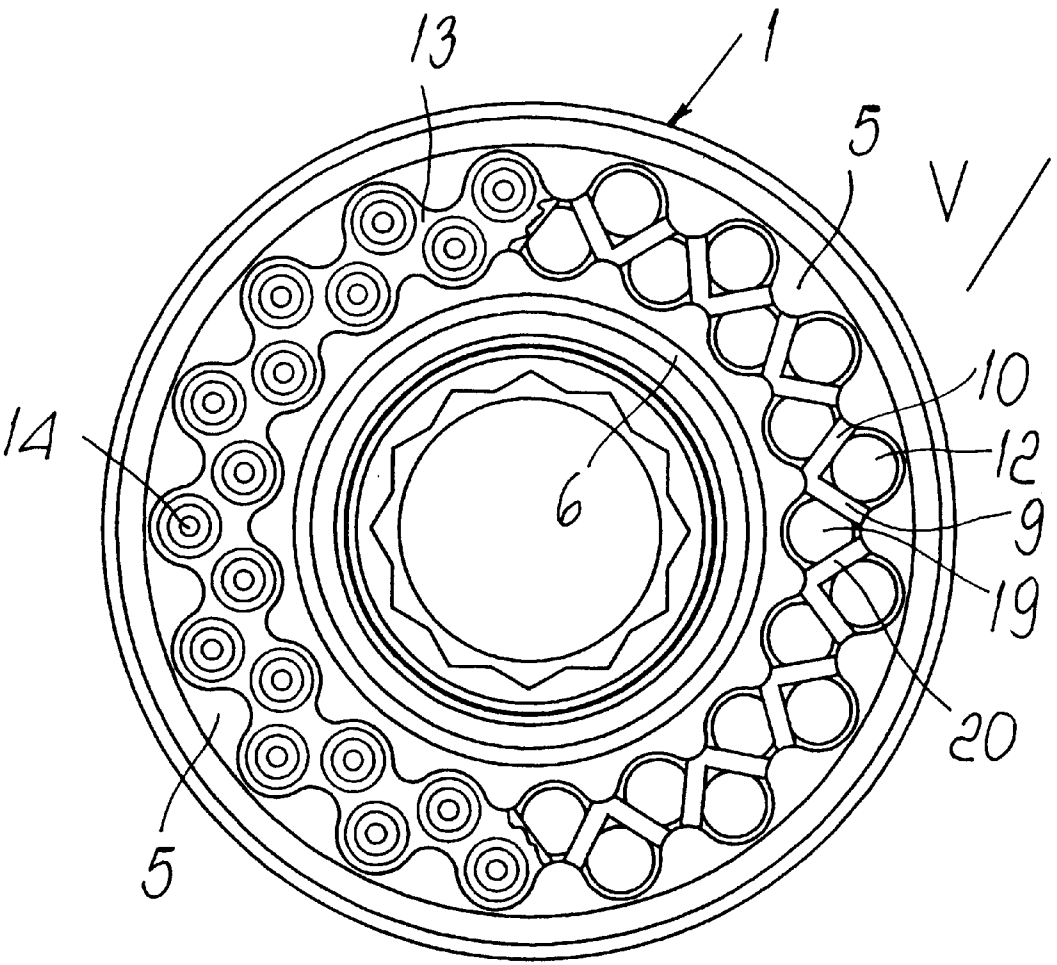
FIG. 4 is a plan view of the disk, taken from outside, with the second element again shown removed in the right portion of the disk.

The disk 1 comprises a second annular element 13 which is made of an elastic material such as rubber and is associated by simultaneous molding with the first element in the region between the peripheral body 5 and the hub 6 where there are connecting cross-members, such as 7, 8, 9 and 10; in this manner said second element 13 is crossed by said cross-members, as clearly shown by FIG. 5.

The second element 13 comprises holes, such as 14 and 15, for the passage of the water that is designed to provide the rim jet. Such holes are formed at passage openings that lie between the cross-members, such as for example the opening 16 for the hole 15, and at the section that leads out of the sprayer of each one of the holes there is a protrusion, such as 14a for the hole 14 and 15*a* for the hole 15.

The scale deposits form at such protrusions and can be broken up by manually deforming the protrusions without the risk of losing the correct position, because of the fact that the element 13 is firmly anchored to the disk 1 by being crossed by the cross-members such as 9.

Additional holes provided in the second element 13 for the passage of the water designed to provide the rim jet are designated by the reference numerals 17 and 18 in FIG. 5 and are formed at the openings, respectively designated by the reference numerals 12 and 19, that are provided between the cross-members 9, 10 and 9, 20, with the corresponding protrusions 17*a*, 18*a*.

Finally, the reference numerals 21 and 22 designate two protrusions which extend monolithically from the annular element 13 so as to cover facing cylindrical walls of the peripheral body 5 and of the hub 6 and end with curled lips 21*a*, 22*a* for engaging the surface of the disk 1 which facilitate a watertight seal, if the bonding between the plastics and the elastic material such as rubber fails, by making contact with gaskets provided in the head of the sprayer.

In the practical execution of the invention, the second element 13 can be associated with the first element by overmolding instead of by simultaneous molding, and all the details may be replaced with other technically equivalent elements; furthermore, the materials used, as well as the shapes and the dimensions, may be any according to requirements.

The disclosures in Italian Utility Model Application No. MN99U000004 from which this application claims priority are incorporated herein by reference.

What is claimed is:

1. A water jet delivery disk in kitchen sprayer, comprising:

a first element, made of a rigid material, which is constituted by a peripheral body, provided with fixing said first element to a sprayer body, by a hub which is designed to convey a central jet, and by cross-members extending between said peripheral body and said hub, with said peripheral body, said hub and said cross-members forming a monolithic body wherein said cross-members are arranged so as to form passage opening for water passage;

a second annular element, made of an elastic material, which is associated with the first element so as to completly embed said cross-members at least in a region between the peripheral body and the hub, and which comprises holes for the passage of water arranged at said passage openings formed by the cross-members to provide a rim jet, said second annular element being further provided with a protrusion which protrudes from a surface thereof that is directed toward the outside of the sprayer at an outlet section of each one of said holes.

2. The disk of claim 1, wherein said second element is associated with the first element by simultaneous molding.

3. The disk of claim 1, wherein the second element is associated with the first element by overmolding.

4. The disk of claim 1, wherein said peripheral body and said hub have, in a region thereof adapted to be crossed by water before entering said holes of the second element, respective facing cylindrical walls, said second annular element further comprising covering protusions which extend monolithically therefrom along said facing walls to end at a free end thereof with curled lips which engage at a surface of the disk.

5. A water jet delivery disk in a kitchen sprayer, comprising:

a first element, including a peripheral body, provided with fixing means for fixing said first element to a sprayer body, a hub formed so as to convey a water central jet, and cross-members extending between said peripheral body and said hub, with said peripheral body, said hub and said cross-members are provided as a monolithic structure made of a rigid material, and wherein said cross-members extend between said peripheral body and said hub so as to form passage openings which allow water passage;

a second annular element, made of an elastic material, which is associated with the first element so as to be molded over and embed completely said cross-members at least at a region located between the peripheral body and the hub, and which comprises holes for the passage of water arranged at said passage openings formed by the cross-members to provide a rim jet, said second annular element being further provided with an elastically deformable protusion which protudes from a surface thereof that is directed toward the outside of the sprayer at an outlet section of each one of said holes so as to be accessible for manual deformation and scale deposit breaking up.

6. The disk of claim 5, wherein the second element is associated with the first element by simultaneous molding.

7. The disk of claim 5, the second element is associated with the first element by overmolding.

8. The disk of claim 5, wherein said peripheral body and said hub have, in a region thereof adapted to be crossed by water before entering said holes of the second element, respective facing cylindrical walls, said second annular element further comprising covering protusions which extend monolithically therefrom along said facing walls to end at a free end thereof with curled lips which engage at a surface of the disk.

* * * * *